United States Patent [19]

Rodriguez, Jr. et al.

[11] Patent Number: 4,587,671

[45] Date of Patent: May 13, 1986

[54] OPEN, WRAPAROUND, SLEEVED GARMENT

[75] Inventors: Richard Rodriguez, Jr.; Joseph Israel, both of El Paso, Tex.

[73] Assignee: American Hospital Supply Corporation, Evanston, Ill.

[21] Appl. No.: 702,985

[22] Filed: Feb. 19, 1985

[51] Int. Cl.[4] ..... A41D 1/04

[52] U.S. Cl. ..... 2/69; 2/243 B; 2/114

[58] Field of Search ..... 2/75, 80, DIG. 7, 74, 2/114, 83, 243 R, 243 B, 106, 113; 66/176

[56] References Cited

U.S. PATENT DOCUMENTS

| | | | |
|---|---|---|---|
| 1,256,736 | 2/1918 | Sheehy | 2/80 |
| 1,524,345 | 1/1925 | DuBose | 2/75 |
| 4,102,155 | 7/1978 | Robinson et al. | 66/176 |
| 4,107,955 | 8/1978 | Robinson et al. | 66/176 |
| 4,257,127 | 3/1981 | Kaupin et al. | 2/75 |
| 4,304,007 | 12/1981 | Mitsuru | 2/74 |
| 4,473,908 | 10/1984 | Knecht | 2/243 |

FOREIGN PATENT DOCUMENTS

| | | | |
|---|---|---|---|
| 129875 | 7/1919 | United Kingdom | 2/75 |

*Primary Examiner*—Ronald Feldbaum
*Attorney, Agent, or Firm*—Roger A. Williams

[57] ABSTRACT

An open, wraparound, sleeved garment and method of its manufacture from an integral single piece garment blank of flexible material. The open, wraparound, sleeved garment includes the single piece of flexible material seamed to itself along two separate seams, each of which extends from an end of a sleeve to a point along each opened edge of the garment.

7 Claims, 3 Drawing Figures

OPEN, WRAPAROUND, SLEEVED GARMENT

BACKGROUND OF THE INVENTION

U.S. Pat. No. 3,699,591 discloses a method of making disposable garments such as back opening, wraparound, and sleeved gowns. Such garments or gowns are especially suitable for use as patient gowns or as surgical gowns.

Generally, such gowns are constructed as is disclosed in U.S. Pat. No. 3,699,591 wherein at least two separate panels are joined together to form a garment. More commonly, surgical gowns are constructed from a face panel and two side panels which include sleeves or to which separately formed sleeves are attached. The side panels are seamed to the face panel along their adjoining edges to construct the gown.

It would be desirable to provide a gown which can be constructed from a single garment blank such as a flat sheet of flexible textile material. It would be desirable to provide a flat sheet of textile material as a garment blank which could be converted to a three dimensional, sleeved garment and which could be formed into such a three dimensional, sleeved garment by joining edges of the garment blank together along only two seam lines.

SUMMARY OF THE INVENTION

The invention herein is directed to an open, wraparound, sleeved garment which can be formed by providing only two seam lines in the garment. The invention is also directed to a garment blank comprising a flat sheet of flexible material which can be converted to the open, wraparound, sleeved garment by seaming the edges of the material of the garment blank along only two seam lines. In addition, the invention herein is directed to a method of constructing an open, wraparound, sleeved garment from a garment blank using only two seam lines to form the finished garment.

In a more particular aspect, the open, wraparound, sleeved garment that is the subject of the invention herein is especially suited for use as a surgical gown. The open, wraparound, sleeved garment is constructed with only two seams wherein each seam extends from the end of a sleeve to the open or exposed edge of a side flap panel of the garment which is designed to overlap the other side flap panel of the garment. The open, wraparound, sleeved garment is manufactured from a garment blank which is a flat sheet of flexible material which can be a textile material or a woven or nonwoven material. The invention with regard to the garment blank resides in the pattern in which the garment blank is cut so that the open, wraparound, sleeved garment can be constructed with but two seams. The sheet of flexible material which comprises the garment blank is defined by its edges. To define the garment blank, the sheet of flexible material includes a first edge and a second edge which extends generally parallel to and is spaced from the first edge. The garment blank also includes a first pair of sleeve edges which are joined by a first sleeve end edge, which end edge will define the lower terminus of the sleeve. There is also a second pair of sleeve edges which are joined by a second sleeve end edge which defines the lower terminus of the second sleeve. Each pair of the first and second pair of sleeve edges and their corresponding sleeve end edges define a sleeve on the garment to be formed.

Each pair of sleeve edges comprises a first sleeve edge which extends from the respective sleeve end edge to an end of the first edge and a second sleeve edge which extends from the respective sleeve end edge as a slit in the flexible material substantially parallel to the first and second edges for a length about equal to the length of the first sleeve edge.

The flexible material comprising the garment blank also includes a first seam edge which extends along the slit forming the second sleeve edge of the first pair of sleeve edges. The first seam edge extends a length equal to one-half of the length of the first edge. There is also a second seam edge which extends along the slit forming the second sleeve edge of the second pair of sleeve edges a length equal to one-half of the length of the first edge.

A third edge extends between an end of the first seam edge and an end of the second edge. A fourth edge extends between an end of the second seam edge and the other or remaining end of the second edge. The above described edges all define the outer perimeter of the garment blank. The garment blank also includes a generally circular edge in the flexible material which provides a generally circular space in the material. The generally circular edge is centered between the first edge and the two parallel second sleeve edges. The two parallel second sleeve edges are in line with one another such that if they were extended they would meet. In the garment blank there is also a slit which extends generally perpendicular from the first edge at about the mid point of the first edge. The slit extends into the flexible material and diametrically intersects the circular edge. The slit divides the first edge into a first portion which extends from the slit to an end of the first sleeve edge of the first pair of sleeve edges and a second portion which extends from the slit to and end of the first sleeve edge of the second pair of sleeve edges.

The garment is constructed from the garment blank by joining the first portion of the first edge with the first seam edge and the first sleeve edge with the second sleeve edge at the first pair of sleeve edges in one continuous first seam. Subsequently, the second portion of the first edge is joined to the second seam edge and the first sleeve edge and second sleeve edge of the second pair of sleeve edges are joined in one continuous second seam. The open, wraparound, sleeved garment is then created by such two seaming steps.

DETAILED DESCRIPTION

The open, wraparound, sleeved garment that is the subject of the invention herein will be described with regard to the accompanying drawings. With regard to the drawings, FIG. 1 illustrates a garment blank 10 which can be used to construct the open, wraparound, sleeved garment which is shown in FIG. 2 in a partially formed state and in its completed state in FIG. 3.

The description of the garment herein will be described first with regard to FIG. 1 and the description of the garment blank shown therein. The garment blank 10 shown in FIG. 1 can be formed through subsequent steps into the partially formed garment shown in FIG. 2 and subsequently into the completed garment shown in FIG. 3.

The garment blank 10 is a flat sheet of flexible material which can be used to construct a garment. Generally, such flexible material can include any suitable flexible material whether it be woven or nonwoven. A nonwoven material can be selected and such material consists of material which is made by processes other than knitting or weaving. In a preferred embodiment of the invention herein where the garment to be formed is to be used as a surgical gown, the material selected is a nonwoven material.

Figure 1:
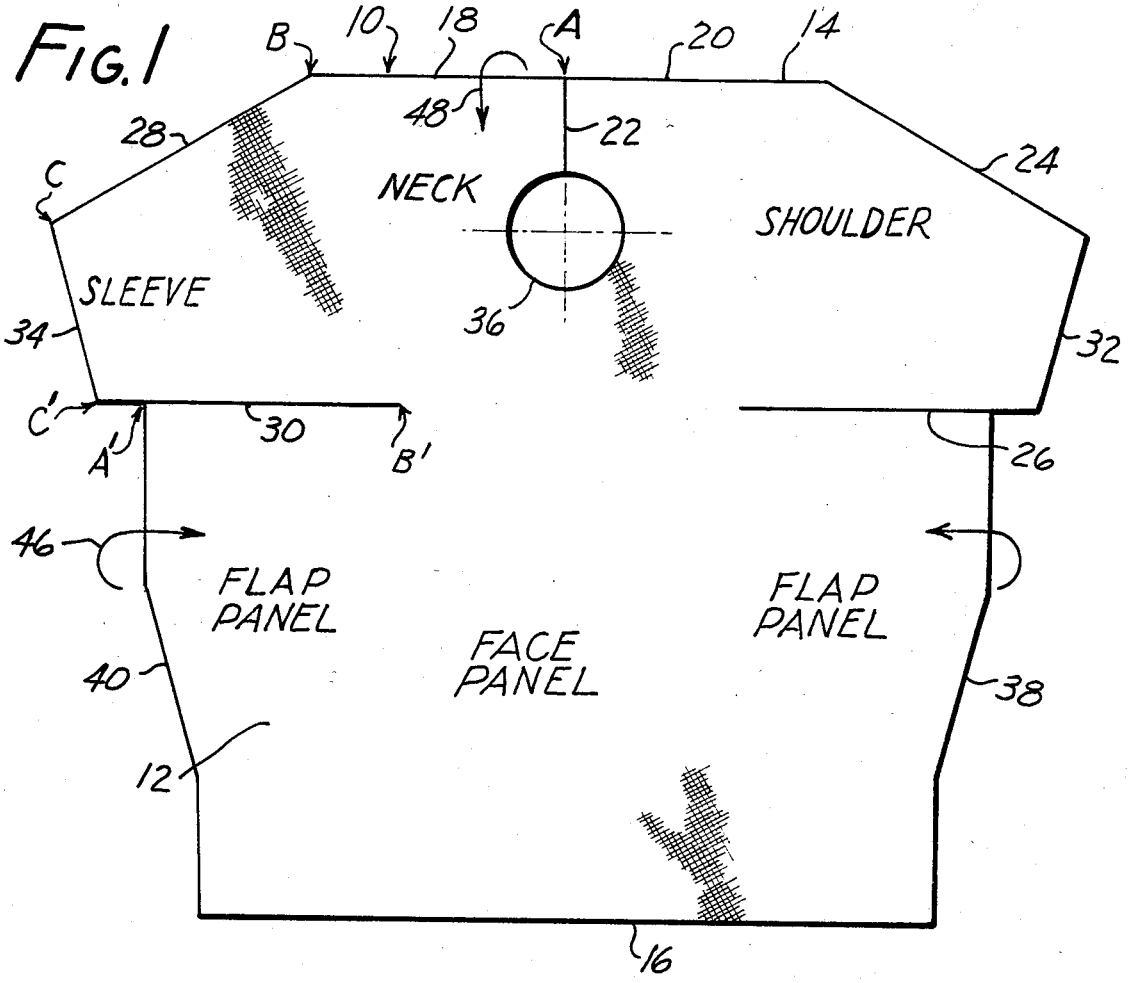
FIG. 1 is a back elevational view of the garment blank which can be formed into the open, wraparound, sleeved garment.
Figure 2:
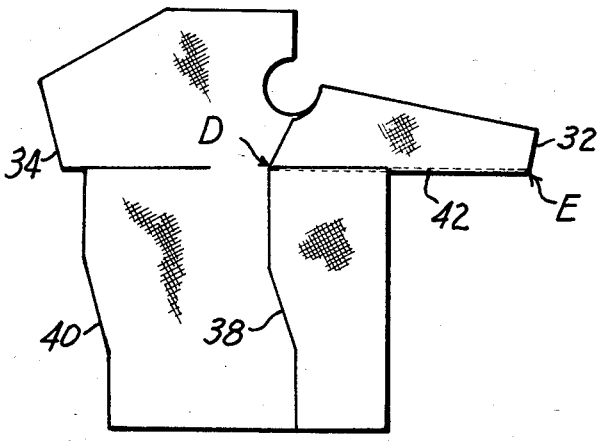
FIG. 2 is a back elevational view of the garment blank shown in FIG. 1 further showing the open, wraparound, sleeved garment partially formed.

The garment blank 10 is a flat sheet of flexible material 12 which is defined by its edges cut in the manner depicted in FIG. 1. The garment blank has a first edge 14 which is generally a straight edge and a second straight edge 16 which extends parallel to and spaced from the first edge 14. The spacing between the first edge 14 and second edge 16 comprises a length greater than the length of the garment to be formed as will hereinafter become apparent. The first edge 14 is bisected into two equal parts which form a first portion 18 and a second portion 20. The first edge 14 is bisected by a slit 22 which forms the first and second portions.

The garment blank also includes two pair of sleeve edges which will form the sleeves on the finished garment. The first pair of sleeve edges consists of a first sleeve edge 24 and a second sleeve edge 26. Extending between the first sleeve edge 24 and second sleeve edge 26 is a first sleeve end edge 32 which forms the lower end of the sleeve of the garment (see FIG. 3). The first sleeve edge 24 extends between the first sleeve end edge 32 and an end of the first edge 14. The second sleeve edge 26 is a slit into the flexible material 12 of the garment blank along at least a portion of its length. The second sleeve edge 26 extends a length equal to the length of the first sleeve edge 24 and is parallel to both the first edge 14 and second edge. 16.

The second pair of sleeve edges consists of a first sleeve edge 28 and a second sleeve edge 30. The first and second sleeve edges of the second sleeve edge pair are joined by a second sleeve end edge 34 extending between the first and second sleeve edges. The second sleeve end edge forms the lower end of the sleeve on the garment as is shown more fully in FIG. 3. As with the first pair of sleeve edges, the first sleeve edge 28 of the second sleeve edge pair extends between the second sleeve end edge 34 and an end of the first edge 14. The second sleeve edge 30 extends from the remaining end of the second sleeve end edge 34 and is a slit extending into the flexible material 12 at least along a portion of its length. The second sleeve edge has a length equal to the length of the first sleeve edge 28. Of course, for the sleeves to be of the same length, the first sleeve edge and second sleeve edge of the first pair of sleeve edges are equal in length to the first sleeve edge and second sleeve edge of the second pair of sleeve edges.

The respective portions of each of the second sleeve edges 26 and 30 which are slits extending into the flexible material 12 also form temporary edges on the two flap panels. As indicated above, the slit in the flexible material 12 (e.g. the line shown as A'B' in FIG. 1) extends a length equal to one-half of the length of the first edge 14. Stated in a different manner, the length of the slit in the flexible material is equivalent to the length of either the first portion 18 or second portion 20 of the first edge 14. The reason for the length of the slit being equivalent to the lengths of the first and second portions will be apparent hereinafter but briefly is necessary as the first portion and second portion of the first edge are joined to the two seam edges formed respectively by the slits extending through the flexible material. The slits in the material form a first seam edge and a second seam edge, A'B'.

The garment blank 10 is further defined by a first exposed edge 38 which extends between an end of the second edge 16 and the outer end of the slit forming the second sleeve edge of the first sleeve edge pair; i.e., an end of the first seam edge. Correspondingly, a second exposed edge 40 extends between the remaining end of the second edge 16 and the outward end of the slit forming the second sleeve edge 30 of the second sleeve edge pair; i.e., an end of the second seam edge.

The exposed edges 38 and 40 form at least a portion of the exposed edges of the finished garment. The remaining portions of the exposed edges of the finished garment being formed from the length of material along slit 22.

The garment blank also includes a circular opening which forms the head or neck opening of the garment. The circular opening is defined by a circular neck edge 36. The circular neck edge 36 is centered between the first edge 14 and the two second sleeve edges 26 and 30. The two second sleeve edges 26 and 30 are aligned with one another. If they were extended, they would meet. That is, the two second sleeve edges 26 and 30 are at a 180° angle to one another. The circular neck edge 36 is also positioned such that it is diametrically bisected by the slit 22, which slit also bisects the first edge 14 and which slit is perpendicular to such first edge 14. More simply stated, the slit 22, if extended, would form a diameter extending through the center of the circular neck opening 36 while also extending through the midpoint of first edge 14 at a right angle.

The open, wraparound, sleeved garment that is formed from the garment blank 10 is formed by the following steps. The garment blank 10 is cut from a sheet of flexible material in the pattern shown in FIG. 1. After cutting the garment blank 10, the garment blank includes the sections identified in FIG. 1 which would include two shoulder sections, the neck portion, two sleeve portins, two flap panels which will overlap, and a face panel. With regard to FIG. 1, the garment blank therein can be folded either into or away from the plane of the material to form the garment. For simplicity and in order to describe the method of forming the garment, the method will be described with regard to folding the garment blank outwardly in the direction of arrows 46 and 48 away from the plane of the material. That is, the surface of the material facing outwardly of the page will become the inside surface of the garment.

To form the garment, the first sleeve edge 24 is folded toward the second sleeve edge 26 so that the two sleeve edges coincide and can be seemed along a first seam 42 as shown in FIG. 2. The right hand flap panel including the first exposed edge 38 is folded inward of the flexible material so that the portion of the flap panel formed by the slit coinciding with the second sleeve edge 26 (i.e. first seam edge) mates with the first portion 20 of the first edge 14. The mating or joining forms a continuation of the first seam 42 as is shown in FIG. 2. The first seam 42 extends between points D and E in one continuous seam line. The seam can be formed by any acceptable seaming technique such as by sewing, adhesively joining, heat forming, and the like. When the first seam 42 is formed, then one-half of the garment has been constructed as is shown in FIG. 2. Such one-half of the garment includes a formed sleeve and a completed back panel having an open edge coinciding with the first exposed edge 38. The lower terminus of the sleeve is formed by the first sleeve end edge 32.

Figure 3:
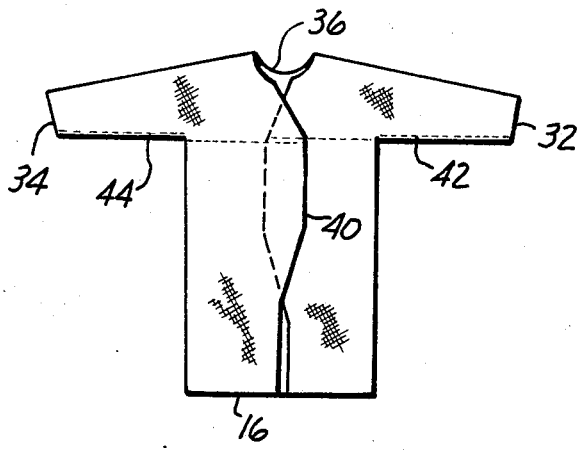
FIG. 3 is a back elevational view of an open, wraparound, sleeved garment formed from the garment blank shown in FIG. 1.

The garment is completed by performing the same steps on the left hand portion of the garment blank. That is, the first sleeve edge 28 and second sleeve edge 30 of the second pair of sleeve edges are folded such that the first sleeve edge 28 coincides with the second sleeve edge 30. With reference to FIG. 1, the material is folded such that the first sleeve edge defined by line CB is moved to coincide with a second sleeve edge shown by line C'B'. Point C is mated with point C' and point B is mated with point B'. Concomitantly, the second portion 18 of the first edge 14 is folded to coincide with the upper portion of the flap panel defined by the second seam edge A'B'. A'B' is the slit in the garment which forms a portion of the length of the second sleeve edge 30. The left flap panel is folded inward of the flexible material and since point B has been mated with point B', point A is mated with point A'. That is, the second portion 18 of the first edge 14 is moved in the direction of the arrow 48 and the second exposed edge 40 is moved in the direction of arrow 46 to align the edges shown respectively by lines AB and A'B'. As stated above, it should be recalled that the length of AB is equivalent to the length of A'B' and the length of the line BC is equivalent to the length of line B'C'. After rotating and aligning the edges, a second seam 44 completes the formation of the garment as is shown in FIG. 3. The second seam is then a seam joining an edge illustrated as AC to an edge illustrated as A'C'.

In regard to FIG. 3, a finished garment is illustrated which consists of an open, wraparound, sleeved garment having a face panel and two side flap panels, each of which has an open exposed edge and which are designed to overlap along or at their exposed edges to close the garment. The garment includes a circular neck edge 36, two sleeves formed by lower or sleeve end edges 32 and 34, and a lower portion formed by the second edge 16 of the garment blank. The two exposed edges overlap and in the illustration of FIG. 3, the second exposed edge 40 is shown as overlapping the first exposed edge. The garment is formed by two continuously extending seams which are illustrated in phantom by a first seam 42 and the second seam 44. The garment thus formed is an improvement over the state of the garments in that it can be simply and economically formed by cutting the garment blank pattern shown in FIG. 1 and joining the edges of the garment blank to form a completed, finished garment with but two seam lines.

I claim:

1. A garment blank for an open, wraparound, sleeved garment having a face panel and two side flap panels integral with the face panel, each of which has an exposed edge and which side flap panels overlap at their respective exposed edges to close the garment, the garment blank comprising:

a sheet of flexible material defined by a generally straight first edge and a generally straight second edge extending generally parallel to and spaced from the first edge;

a first pair of nonparallel sleeve edges joined by a first sleeve end edge and a second pair of nonparallel sleeve edges joined by a second sleeve end edge, each pair of sleeve edges and related sleeve end edges defining a sleeve on the garment to be formed and each pair of sleeve edges comprising a first sleeve edge extending from the sleeve end edge to an end of the first edge and a second sleeve edge extending from the sleeve end edge as a slit in the sheet of flexible material substantially parallel to the first edge and for a length equal to the length of the first sleeve edge;

a first seam edge extending along the slit forming a second sleeve edge of the first pair of sleeve edges a length equal to one-half of the length of the first edge and a second seam edge extending along the slit forming a second sleeve edge of the second pair of sleeve edges a length equal to one-half of the length of the first edge;

a third edge extending between an end of the first seam edge and an end of the second edge;

a fourth edge extending between an end of the second seam edge and the other end of the second edge;

a generally circular edge in the sheet of flexible material centered between the first edge and the two parallel second sleeve edges; and a slit extending generally perpendicularly from the first edge at about the midpoint of the first edge and which slit diametrically intersects the circular edge.

2. A garment blank as recited in claim 1 wherein the first edge comprises a length about twice as long as the width of a side flap panel.

3. A garment blank as recited in claim 1 wherein the second edge comprises a length about equal to the sum of the lengths of the first edge and the width of the face panel.

4. A garment blank as recited in claim 1 wherein the sheet of flexible material comprises a nonwoven material.

5. A method of forming an open, wraparound, sleeved garment having a face panel and two side flap panels integral with the face panel, each of which has an exposed edge and which side flap panels overlap at their respective exposed edges to close the garment, the method comprising the steps of:

cutting a sheet of flexible material to form a straight first edge and a straight second edge extending generally parallel to and spaced from such first edge;

cutting a first pair of sleeve edges and a first sleeve end edge joining the first pair of sleeve edges;

cutting a second pair of sleeve edges and a second sleeve end edge joining the second pair of sleeve edges wherein each pair of the sleeve edges comprises a first sleeve edge extending from its respective sleeve end edge to an end of the first edge and a second sleeve edge extending from its respective sleeve end edge as a slit in the flexible material substantially parallel to the first edge and for a length equal to the length of the first sleeve edge;

cutting a first seam edge extending along the slit forming a second sleeve edge of the first pair of sleeve edges a length equal to one-half the length of the first edge;

cutting a second seam edge extending along the slit forming a second sleeve edge of the second pair of sleeve edges a length equal to one-half of the length of the first edge;

cutting a third edge extending between and end of the first seam edge and an end of the second edge;

cutting a fourth edge extending between an end of the second seam edge and the other end of the second edge;

cutting a generally circular edge in the flexible material centered between the first edge and the two parallel second sleeve edges;

cutting a slit extending generally perpendicularly from the first edge which divides the first edge into a first portion and second portion and which slit diametrically intersects the circular edge;

folding the flexible material to align the first sleeved edge and second sleeve edge of the first pair of sleeve edges;

folding the flexible material to align the first sleeve edge and second sleeve edge of the second pair of sleeve edges;

folding the flexible material to align the first seam edge with the first portion of the first edge;

folding the flexible material to align the second seam edge with the second portion of the first edge;

seaming the aligned first sleeve edge and aligned second sleeve edge of the first pair of seam edges and the first seam edge and the aligned first portion of the first edge in one continuous seam; and seaming the aligned first sleeve edge and the aligned second sleeve edge of the second pair of sleeve edges and the second seam edge and the aligned second portion of the first edge in one continuous seam.

6. A method as recited in claim 5 wherein the steps of seaming are performed by sewing.

7. A method as recited in claim 5 wherein the steps of seaming are performed by adhesively bonding.

* * * * *